US007258563B2

(12) United States Patent
Ju

(10) Patent No.: US 7,258,563 B2
(45) **Date of Patent: *Aug. 21, 2007**

(54) FASTENING STRUCTURE AND SOCKET USING THE SAME

(75) Inventor: Ted Ju, Taipei (TW)

(73) Assignee: Lotes Co, Ltd., Keelung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/211,006

(22) Filed: Aug. 25, 2005

(65) Prior Publication Data

US 2006/0199413 A1 Sep. 7, 2006

(30) Foreign Application Priority Data

Mar. 2, 2005 (CN) ..... 2005 2 0055120

(51) Int. Cl.
*H01R 13/62* (2006.01)

(52) U.S. Cl. ..... 439/331

(58) Field of Classification Search ..... 439/330, 439/331, 73; 361/709, 710, 719
See application file for complete search history.

(56) References Cited

U.S. PATENT DOCUMENTS 6,776,625 B2 * 8/2004 Ma ..... 439/73
6,899,553 B2 * 5/2005 Ma et al. ..... 439/135
7,137,840 B1 * 11/2006 Ju ..... 439/330

* cited by examiner

*Primary Examiner*—Neil Abrams
(74) *Attorney, Agent, or Firm*—Rosenberg, Klein & Lee

(57) ABSTRACT

A socket adapted for electrically connecting the chip module to a printed circuit board includes an insulative housing, a plurality of contacts receiving in the insulative housing, and a fastening structure. The fastening structure includes an upper lever and a lower lever related to each other; wherein the upper lever includes an upper axis pivoted to the first object, an upper press portion rotatable about the upper axis, and an upper operation portion; the lower lever includes a lower axis pivoted to the first object, a lower press portion rotatable about the lower axis, and a lower operation portion. Whereby the upper operation portion of the upper lever moves downwardly so as to carry the lower operation portion of the lower lever downwardly, thus, the upper and lower press portions suppress the chip module simultaneously.

11 Claims, 6 Drawing Sheets

FASTENING STRUCTURE AND SOCKET USING THE SAME

BACKGROUND OF THE INVENTION

1. Field of the Invention

The present invention relates to a fastening structure and a socket using the same.

2. Background of the Invention

A conventional socket, generally, is used for electrically connecting a chip module to a printed circuit board. The conventional socket, shown in FIGS. 1 to 3, adapted for electrically connecting a chip module 500 to a printed circuit board 600 includes an upper shell 100 and a base 200 connected movably to each other, and further includes a lever 300 fastening the upper shell 100 and the base 200. After the chip module 500 is disposed on the base 200, the upper shell 100 is rotated to press the chip module 500; and then the lever 300 is rotated to abut against the upper shell 100 via a retaining portion thereof and to secure to a tongue portion of the base 200 via an operation portion thereof, so that the chip module 500 secures with the socket firmly. However, the chip module 500 will be easily warped to damage the contacts when the lever 300 drives the upper shell 100 to press on the chip module 500.

SUMMARY OF THE INVENTION

A fastening structure and a socket using the same are provided to electrically connect to the chip module very well for preventing warp when applying to fasten an object.

A fastening structure applying for connecting a first object to a second object, and includes an upper lever and a lower lever related to the upper lever. The upper lever includes an upper axis pivoted to the first object, an upper press portion rotatable about the upper axis, and an upper operation portion. The lower lever includes a lower axis pivoted to the first object, a lower press portion rotatable about the lower axis, and a lower operation portion. The upper operation portion of the upper lever moves downwardly so as to carry the lower operation portion of the lower lever downwardly, thus, the upper and lower press portions suppress the second object simultaneously.

A socket adapted for electrically connecting the chip module to a printed circuit board includes an insulative housing, a plurality of contacts receiving in the insulative housing, and a fastening structure. The fastening structure includes an upper lever and a lower lever related to each other; wherein the upper lever includes an upper axis pivoted to the first object, an upper press portion rotatable about the upper axis, and an upper operation portion; the lower lever includes a lower axis pivoted to the first object, a lower press portion rotatable about the lower axis, and a lower operation portion. Whereby the upper operation portion of the upper lever moves downwardly so as to carry the lower operation portion of the lower lever downwardly, thus, the upper and lower press portions suppress the chip module simultaneously.

Compared with the conventional socket, the upper lever according to the present invention can carry the lower lever to press downwardly, so that the upper and lower levers suppress the chip module together and the contacts of the socket can keep very well because the chip module is not warped.

To provide a further understanding of the invention, the following detailed description illustrates embodiments and examples of the invention. Examples of the more important features of the invention have thus been summarized rather broadly in order that the detailed description thereof that follows may be better understood, and in order that the contributions to the art may be appreciated. There are, of course, additional features of the invention that will be described hereinafter which will form the subject of the claims appended hereto.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

Figure 1:
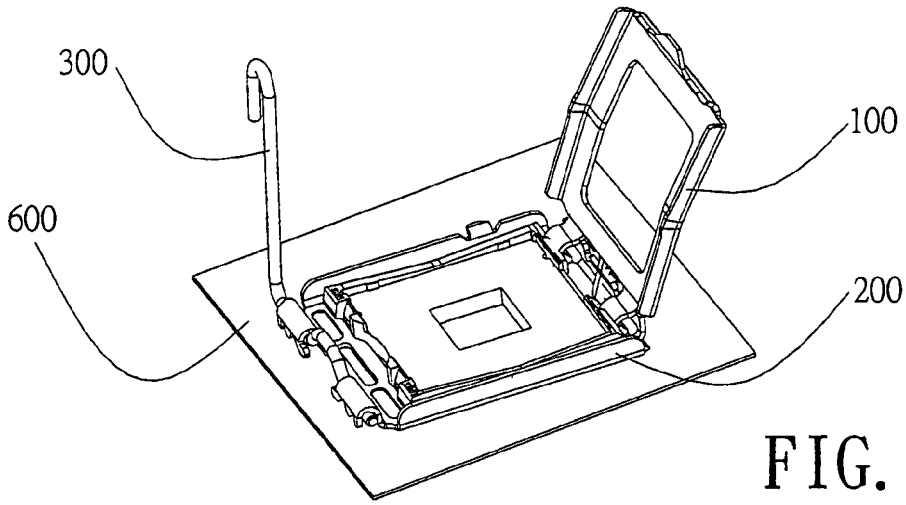
FIG. 1 PRIOR ART
FIG. 1 is a perspective view of a conventional socket while the conventional socket assembled to a printed circuit board.
Figure 2:
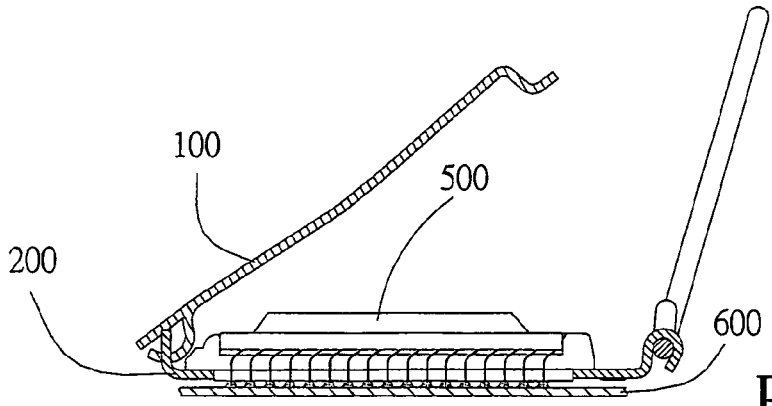
FIG. 2 PRIOR ART
FIG. 2 is a side view of the conventional socket after assembling to a chip module.
Figure 3:
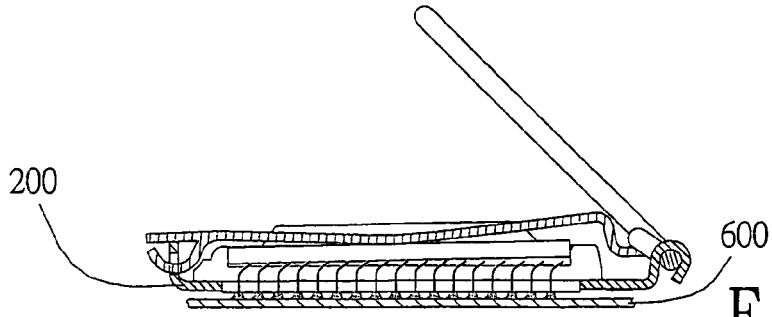
FIG. 3 PRIOR ART
FIG. 3 is a side view of the conventional socket after a lever is rotated to press a chip module.
Figure 4A:
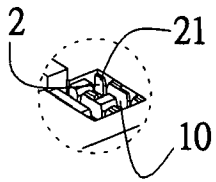
FIG. 4A is an enlarged view of an orientation projection according to FIG. 4.
Figure 4:
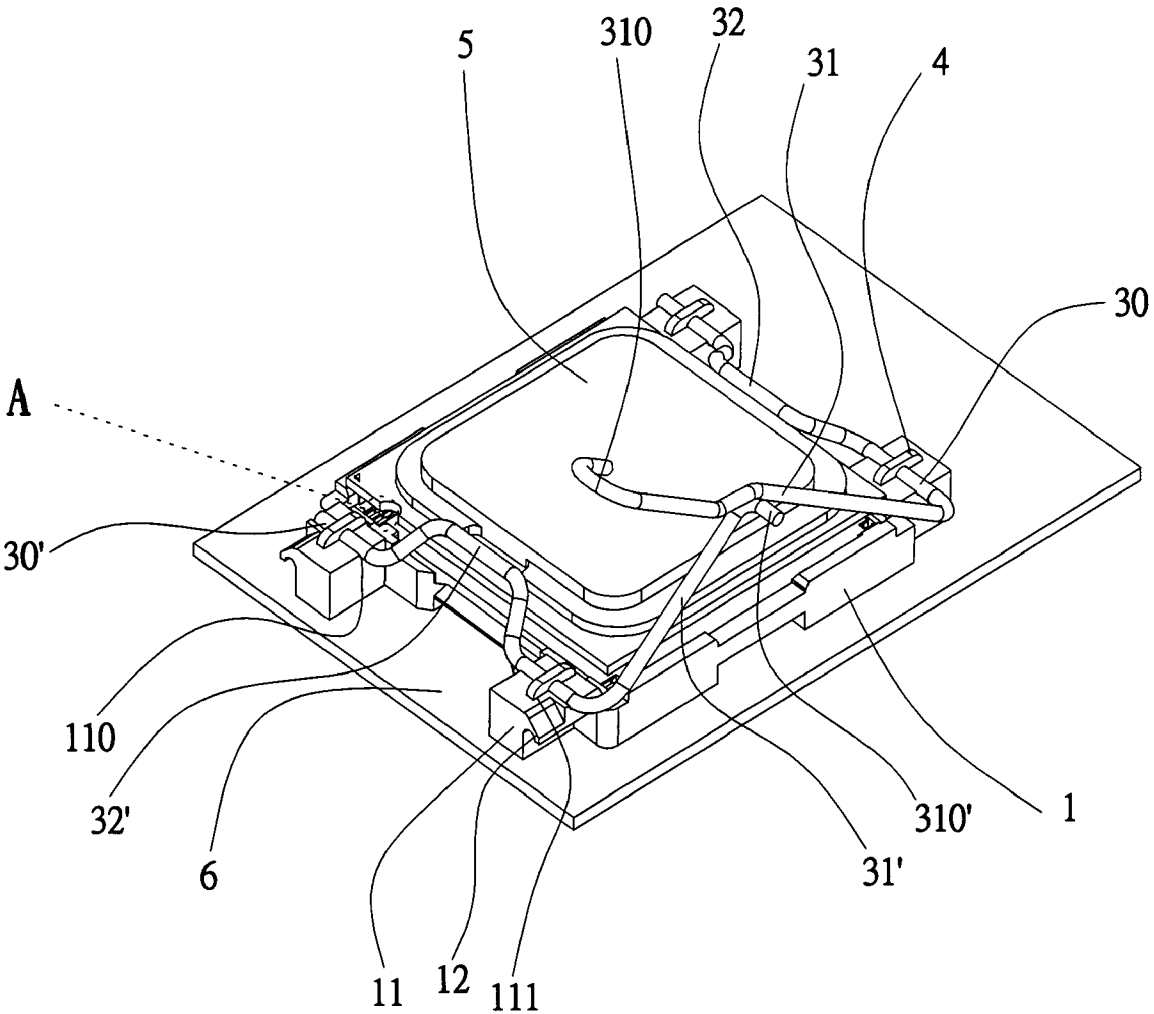
FIG. 4 is a perspective view of a socket in an open state according to the present invention.
Figure 5:
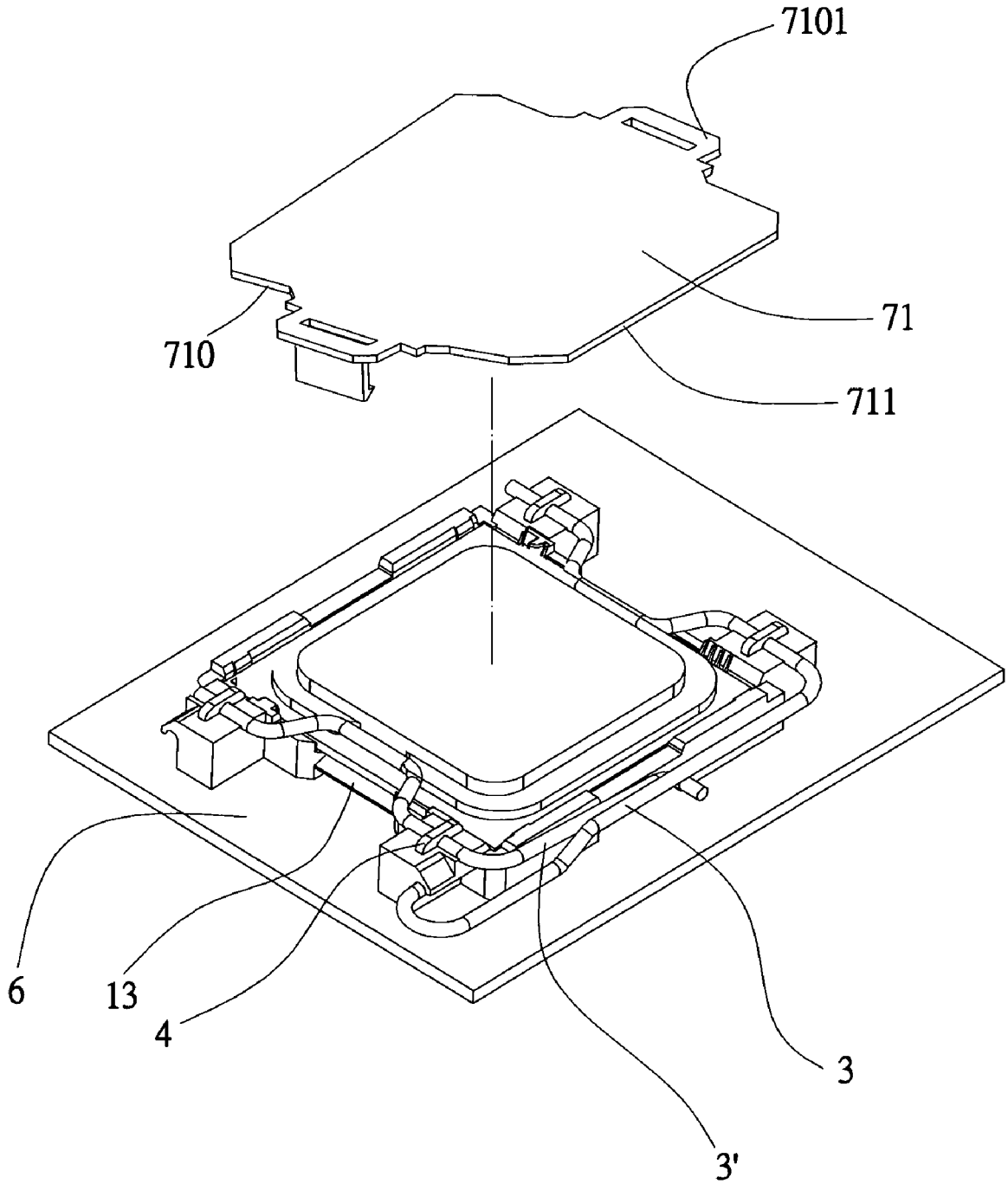
FIG. 5 is a perspective view of the socket according to the present invention after a lever is rotated to press a chip module.
Figure 6:
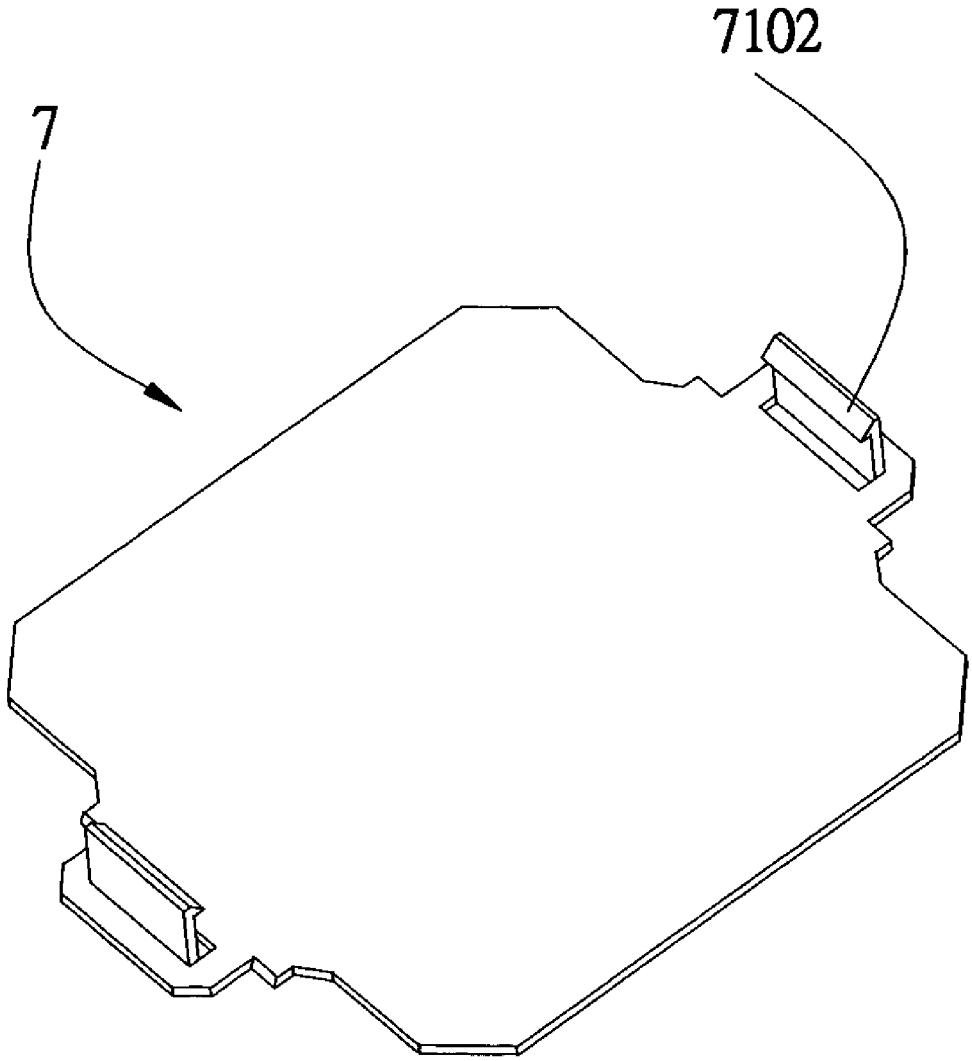
FIG. 6 is a perspective view of an upper shell of the socket according to the present invention.
Figure 7:
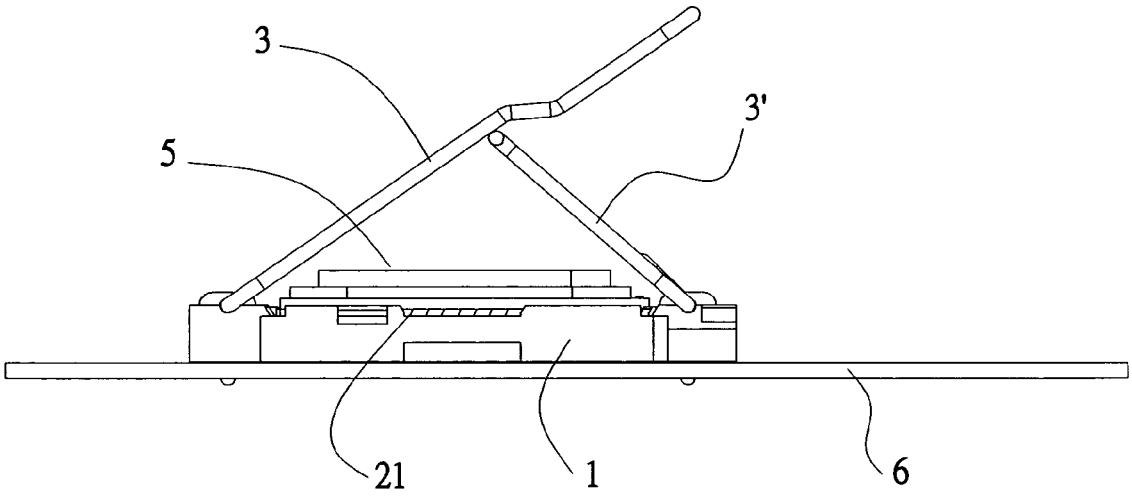
FIG. 7 is a side view of the socket in an open state according to the present invention.
Figure 8:
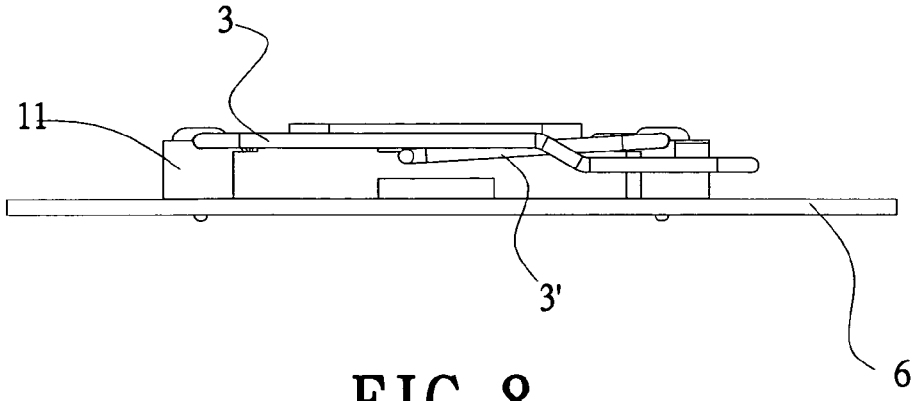
FIG. 8 is a side view of the socket in an open state after the lever is rotated to press the chip module.
Figure 9:
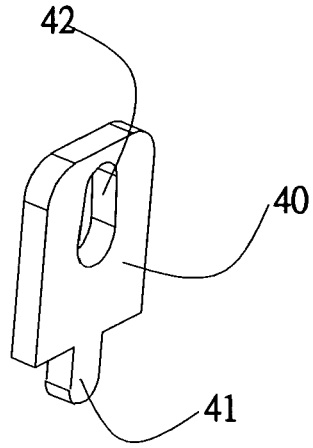
FIG. 9 is a perspective view of a metallic orientation member of the socket according to the present invention.

With respect to FIGS. 4 to 9, a socket according to the present invention includes a base, a plurality of contacts 2, an upper shell 7 and a fastening structure for connecting a chip module 5 to a printed circuit board 6 very well.

The base includes an insulative housing 1 and a metallic member 4 secured to the insulative housing 1. The insulative housing 1 includes a plurality of passageways 10 and an orientation projection 11. Each of the contacts 2 is partially received in the respective passageway 10 for electrically connecting to the printed circuit board 6 and includes a contact portion 21 folded and further has a reveal end connected thereto. The highness point of each contact 2 is lower than an upper surface of the orientation projection 11. The orientation projection 11 includes a receiving slot 110 formed on the upper surface thereof, and a slit 111 communicating with the receiving slot 110 in an vertical manner and penetrating through the orientation projection 11 in order to contain the metallic member 4. In addition, the orientation projection 11 includes a clasping portion 12 arranged on an exterior side thereof outwardly. The insulative housing 1 includes a buckling portion 13 disposed at middle thereof and mating with the upper shell 7.

The metallic member 4 is sliced-like, and includes a body 40, a solder portion 41 extending from the body 40, and a position portion 42 formed on the body,40. The position portion 42 is a through hole for penetrating a lever. The solder portion 41 exposes out of a lower surface of the insulative housing 1 to electrically connect to the printed circuit board 6.

The upper shell 7 is substantially rectangular and can be secured to the insulative housing 1. The upper shell 7 includes a flat plate 71, two first sidewalls 710 arranged on two opposite sides of the flat plate 71, two second sidewalls 711 arranged on another two opposite sides of the flat plate 71, two extension portions 7101 extending outwardly from the first sidewalls 710 respectively, and two clip portions 7102 extending downwardly from a middle of a lower surface of the extension portions 7101 respectively. Each of the extension portions 7101 fastens with the buckling portion 13 of the insulative housing 1, so that the upper shell 7 can cover the insulative housing 1. Thus, the socket can be sucked by a vacuum inhalation.

The fastening structure includes an upper lever 3, and a lower lever 3' related to the upper lever 3. The upper lever 3 includes an upper axis 30, an upper press portion 32 extending from a middle of the upper axis 30, and an upper operation portion 31 vertical to the upper axis 30. The lower lever 3' includes a lower axis 30', a lower press portion 32' extending from a middle of the lower axis 30', and a lower operation portion 31' vertical to the lower axis 30'. Each of the axes 30, 30' can be received in side the receiving slot 110 of the insulative housing 1. The position portion 42 of the metallic member 4 can restrain the vertical movement of each axis 30, 30'; thus, the upper and lower lever 3 and 3' can firmly pivot to the base. The lower operation portion 3' includes an abutting portion 310', which is arranged on an end opposite to and remote from the lower axis 30'; wherein the abutting portion 310' is substantially vertical to the lower operation portion 3' for retaining against the upper operation portion 31 of the upper lever 3; wherein the upper operation portion 31 has a clamping portion 310' disposed on an end opposite to and remote from the upper axis 30 in order to secure with the clasping portion 12. The upper operation portion 31 can be rotated downwardly and against the abutting portion 310' of the lower lever 3', and the lower operation portion 31' will be carried to rotate downwardly. Thus, upper press portion 32 and the lower press portion 32' are carried to suppress the chip module 5 at the same time. A free end of the operation portion 31 clamped under the clasping portion 12, and the chip module 5 then connects with the insulative housing 1 firmly and the contacts 2 inside the insulative housing 1 are kept well from damage.

The levers 3 and 3' are symmetrically arranged at two sides of the insulative housing 1. When the chip module 1 connects the socket, there can be only the chip module 5 is disposed on the insulative housing 1. The press portions 32, 32' can touch the chip module 5 first and then be suppressed to abut against the chip module 5, thus, the chip module 5 is pushed downwardly by an average force due to the simultaneous action by the levers 3 and 3'. Therefore, the chip module 5 will not warp and the contacts 2 are not damage.

Figure 10:
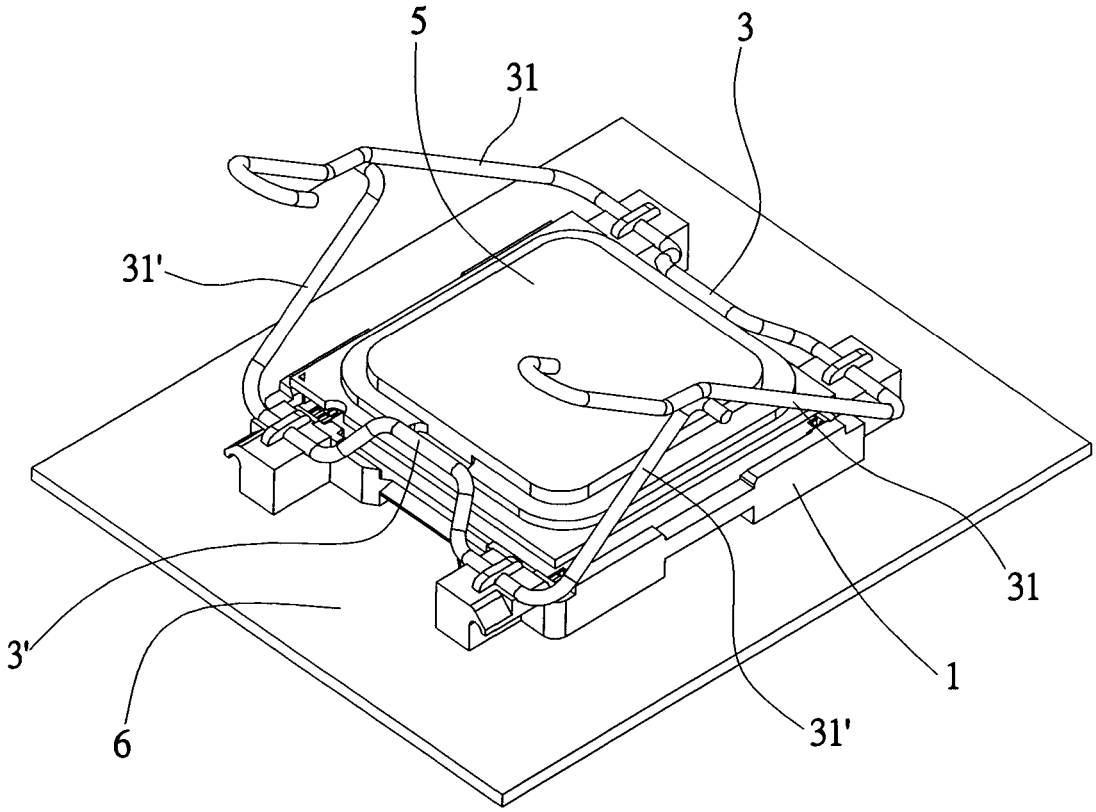
FIG. 10 is a perspective view of another embodiment of the socket according to the present invention.

Each of the upper and lower levers 3 and 3' also includes two operation portions for further average force in FIG. 10.

Besides, the metallic member 4 can be omitted, and each lever 3 or 3' can be secured to the insulative housing 1 by pivoted with a passageway formed on an orientation projection 11 in advance.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A fastening structure for connecting a first object to a second object comprising:

an upper lever including an upper axis pivoted to the first object, an upper press portion projecting inwardly from a center portion of the upper axis and rotatable about the upper axis, and an upper operation portion being disposed on an end of the upper axis and perpendicular thereto; and a lower lever interoperable with the upper lever and including a lower axis pivoted to the first object, a lower press portion projecting inwardly from a center portion of the lower axis and rotatable about the lower axis, and a lower operation portion being disposed on an end of the lower axis and perpendicular thereto;

whereby the upper operation portion of the upper lever engages the lower operation portion of the lower lever by downward movement thereof to rotate the upper and lower press portions, which simultaneously apply thereby a respective force on the second object toward the first object.

2. The fastening structure as claimed in claim 1, wherein the lower operation portion includes an abutting portion, which is arranged on an end opposite to and remote from the lower axis; wherein the abutting portion is substantially vertical to the lower operation portion for retaining against the upper operation portion of the upper lever; wherein the upper operation portion has a clamping portion disposed on an end opposite to and remote from the upper axis in order to secure with the first object.

3. The fastening structure as claimed in claim 1, further including an additional upper operation portion and an additional lower operation portion, wherein the two upper operation portions are arranged at two lateral sides of the upper axis respectively, and the lower upper operation portions are arranged at two lateral sides of the lower axis respectively.

4. A socket adapted for electrically connecting a chip module to a printed circuit board comprising:

an insulative housing affixed to the printed circuit board;

a plurality of contacts disposed in the insulative housing; and a fastening structure including:

an upper lever includes including an upper axis pivoted to the insulative housing, an upper press portion projecting inwardly from a center portion of the upper axis and rotatable about the upper axis, and an upper operation portion being disposed on an end of the upper axis and perpendicular thereto the upper axis; and a lower lever interoperable with the upper lever and including a lower axis pivoted to the insulative housing, a lower press portion projecting inwardly from a center portion of the lower axis and rotatable about the lower axis, and a lower operation portion being disposed on an end of the lower axis and perpendicular thereto;

whereby the upper operation portion of the upper lever engages the lower operation portion of the lower lever by downward movement thereof to rotate the upper and lower press portions, which simultaneously apply thereby a respective force on the chip module towards the insulative housing.

5. The socket as claimed in claim 4, further including a metallic member fastening the insulative housing to each of the upper and lower levers, wherein the metallic member has a through hole for receiving each of the upper and lower axes.

6. The socket as claimed in claim 4, wherein the lower operation portion includes an abutting portion, which is arranged on an end opposite to and remote from the lower axis; wherein the abutting portion is substantially vertical to the lower operation portion for retaining against the upper operation portion of the upper lever.

7. The socket as claimed in claim 4, wherein the insulative housing includes a clasping portion arranged on an exterior side of an orientation projection; the upper operation portion has a clamping portion disposed on an end opposite to and remote from the upper axis in order to secure with the clasping portion of the insulative housing.

8. The socket as claimed in claim 4, further including an additional upper operation portion and an additional lower operation portion, wherein the two upper operation portions are arranged at two lateral sides of the upper axis respectively, and the lower upper operation portions are arranged at two lateral sides of the lower axis respectively.

9. The socket as claimed in claim 4, further including an upper shell disposed over the insulative housing.

10. The socket as claimed in claim 9, wherein the upper shell is secured to the insulation housing.

11. A fastening structure for connecting a first object to a second object comprising:

an upper lever including an upper axis pivoted to the first object, an upper press portion rotatable about the upper axis and an upper operation portion;

a lower lever interoperable with the upper lever and including a lower axis pivoted to the first object, a lower press portion rotatable about the lower axis and a lower operation portion, whereby the upper operation portion of the upper lever engages the lower operation portion of the lower lever by downward movement thereof to rotate the upper and lower press portions, which simultaneously apply respective forces on the second object toward the first object.

* * * * *